US009273493B2

(12) United States Patent
Kim

(10) Patent No.: US 9,273,493 B2
(45) Date of Patent: Mar. 1, 2016

(54) KEY CYLINDER FOR ELECTRONIC LOCKING DEVICE

(71) Applicant: Bum Soo Kim, Namyangju-si (KR)

(72) Inventor: Bum Soo Kim, Namyangju-si (KR)

( * ) Notice: Subject to any disclaimer, the term of this patent is extended or adjusted under 35 U.S.C. 154(b) by 0 days.

(21) Appl. No.: 14/394,699

(22) PCT Filed: Sep. 23, 2013

(86) PCT No.: PCT/KR2013/008467
§ 371 (c)(1),
(2) Date: Oct. 15, 2014

(87) PCT Pub. No.: WO2014/051292
PCT Pub. Date: Apr. 3, 2014

(65) Prior Publication Data

US 2015/0096340 A1 Apr. 9, 2015

(30) Foreign Application Priority Data

Sep. 27, 2012 (KR) ..... 10-2012-0107803

(51) Int. Cl.
*E05B 49/00* (2006.01)
*E05B 47/00* (2006.01)
(Continued)

(52) U.S. Cl.
CPC ..... *E05B 47/0012* (2013.01); *E05B 47/063* (2013.01); *E05C 3/042* (2013.01);
(Continued)

(58) Field of Classification Search
CPC ..... E05B 47/0012; E05B 47/0001; E05B 47/026; E05B 47/00; E05B 47/02; E05B 47/06; E05B 2047/0058; E05B 2047/0086; E05B 2047/0067; E05B 2047/002; Y10T 70/7062; Y10T 70/7068; Y10T 70/7102; Y10T 70/7107; Y10T 70/7136; Y10T 70/7113; Y10T 70/7051; Y10T 70/1021
USPC ..... 70/208, 275, 277, 278.1–278.3, 278.6, 70/278.7, 279.1, 280, 283.1
See application file for complete search history.

(56) References Cited

U.S. PATENT DOCUMENTS 3,670,538 A * 6/1972 Curry ..... 70/271
4,080,043 A * 3/1978 Altenheiner et al. ..... 359/416
(Continued)

FOREIGN PATENT DOCUMENTS

JP 10-504075 A 4/1998
JP 2008-168863 A 7/2008
(Continued)

*Primary Examiner* — Suzanne Barrett
*Assistant Examiner* — Morgan McClure
(74) *Attorney, Agent, or Firm* — Novick, Kim & Lee, PLLC; Sang Ho Lee

(57) ABSTRACT

Provided is a key cylinder for an electronic locking device including a cylinder housing forming an appearance and a cylinder plug installed in the cylinder housing to lock and release the cylinder housing, wherein the cylinder plug includes a lock head including a key insertion hole into which a key head of a publicly known electronic key is removably inserted to a front side, a printed circuit board exchanging power and authentication data from the publicly known electronic key by installing key connection pins in a connection housing installed through the lock head, accessing to the key connection pins and equipping with a microprocessor and EEPROM, a driving motor performing normal rotation and reverse rotation drive in accordance with an input signal of the printed circuit board, a spur gear installed in an axis of the driving motor, a lock pin guider fixed in a rear direction of the cylinder plug, a direction conversion rotary ring rotating in accordance with drive of the driving motor by an internal gear rotatably installed through a fixing axis in the center of the lock pin guider and engaged with the spur gear in a front direction and a spiral groove formed in a rear direction, and a lock pin installed in the lock pin guider such that a pin hole formed in a direction perpendicular to an axis direction of the cylinder plug fluctuates, inserted into one side of a spiral groove formed in the direction conversion rotary ring, positioned through a straight guide wall intercommunicating with the pin hole, and appearing and disappearing in lock holes and formed in the cylinder housing by moving in a perpendicular direction to axis rotation of the direction conversion rotary ring through installation of a foot pin performing straight line motion to realized locking and release of the key cylinder.

7 Claims, 11 Drawing Sheets

(51) Int. Cl.
*E05B 47/06* (2006.01)
*E05C 3/04* (2006.01)
*E05B 47/02* (2006.01)

(52) U.S. Cl.
CPC ..... *E05B 47/00* (2013.01); *E05B 47/02* (2013.01); *Y10T 70/7062* (2015.04); *Y10T 70/7068* (2015.04); *Y10T 70/7102* (2015.04); *Y10T 70/7136* (2015.04)

(56) References Cited

U.S. PATENT DOCUMENTS 4,789,859 A * 12/1988 Clarkson et al. ..... 340/5.65
4,982,587 A * 1/1991 Tzou ..... 70/492
RE34,059 E * 9/1992 Akitake ..... 359/700
5,291,241 A * 3/1994 Hirano et al. ..... 355/55
5,782,118 A * 7/1998 Chamberlain et al. ..... 70/278.3
5,857,365 A * 1/1999 Armstrong ..... 70/279.1
6,089,057 A * 7/2000 Spurr ..... 70/264
6,588,243 B1 * 7/2003 Hyatt et al. ..... 70/278.2
6,840,072 B2 * 1/2005 Russell et al. ..... 70/278.3
8,534,102 B2 * 9/2013 Andersson ..... 70/278.7
8,919,026 B2 * 12/2014 Hamilton ..... 42/119
2001/0027671 A1 * 10/2001 Davis ..... 70/278.3
2002/0108413 A1 * 8/2002 Hyatt, Jr. ..... 70/278.3
2002/0189307 A1 * 12/2002 Gokcebay et al. ..... 70/278.3
2005/0172685 A1 * 8/2005 Keightly ..... 70/279.1
2006/0101878 A1 * 5/2006 Dickhans et al. ..... 70/279.1
2006/0156771 A1 * 7/2006 Hauri ..... 70/278.7
2007/0084259 A1 * 4/2007 Bellamy et al. ..... 70/278.7
2008/0078220 A1 * 4/2008 Kim ..... 70/283.1
2008/0134736 A1 * 6/2008 Andersson ..... 70/279.1
2009/0165513 A1 * 7/2009 Bellamy et al. ..... 70/278.7
2011/0067465 A1 * 3/2011 Luo ..... 70/278.7
2013/0014552 A1 * 1/2013 Bench et al. ..... 70/278.7
2013/0298616 A1 * 11/2013 Ullrich et al. ..... 70/278.1
2014/0250956 A1 * 9/2014 Chong ..... 70/278.1
2014/0260456 A1 * 9/2014 Dewalch et al. ..... 70/283.1

FOREIGN PATENT DOCUMENTS

KR 10-1996-0017684 A 6/1996
KR 10-2003-0035267 A 5/2003
KR 10-0653105 B1 12/2006
KR 10-1016903 B1 2/2011

* cited by examiner

KEY CYLINDER FOR ELECTRONIC LOCKING DEVICE

BACKGROUND OF THE INVENTION

1. Field of the Invention

The present invention relates to a key cylinder for an electronic locking device. More particularly, the present invention relates to a key cylinder for an electronic locking device which may improve durability, assemblability and productivity by stabilizing a lock pin which is fluctuated by a direction conversion rotary ring in accordance with operation of a driving motor built in a key cylinder and thereby performs locking and opening (releasing) operations so as to guarantee reliability of operation, and further by simplifying components and assembling a driving part of a driving motor and a passive part of a lock pin operating by a direction conversion rotary ring such that the driving part and the passive part are separated so as to protect components from external shocks.

2. Description of the Related Art

Generally, locking devices are installed to secure drawers of home furniture, furniture, public buildings, various storage spaces of commercial buildings, doors, lockers, facilities and the like.

Locking devices for security are classified into mechanical locking devices and electronic locking devices. Mechanical locking devices may be released by a universal key and the like. In addition, when keys of mechanical locking devices are lost, locking devices must be changed.

Considering such problems, electronic locking devices using electronic keys are suggested to supplement problems of mechanical locking devices.

Korean Patent No. 10-0653105 entitled "Electronic Locking Device Using Solenoid" is characterized in that, using an electronic key having storage and change functions of a release code and other release-related data, a solenoid device operating by a control device in a cylinder is used to lock and release.

Meanwhile, Korean Patent No. 10-0106903 entitled "Cylinder-type Electronic Locking Device" is characterized in that, using an electronic key, a driving motor operating by a control device in a cylinder drives a locking pin to lock and release.

Korean Patent No. 10-0106903 disclosed above describes in a section of "Advantageous Effect" as follows: the cylinder-type electronic locking device locking may minimize power consumption and thereby increase use time of a battery built in an electronic key since, for locking and releasing, a driving motor operates only when a rotary stopper is rotated such that a locking pin is lifted or descended in a through-hole of a second shaft cylinder. In addition, since a rotation control spring preventing arbitrary rotation of a rotation axis of the driving motor is installed, the rotary stopper fluctuating the locking pin may accurately operate and, as such, reliability of locking and releasing may be improved. Furthermore, by designing such that a movement direction (fluctuating direction) of the locking pin is perpendicular to an axis direction of the rotary stopper, resistance to external shocks may be greatly improved and, as such, a locking state may be safely protected from impure motives to release a locking device without permission.

However, FIGS. 1 to 4 of a publication of Korean Patent No. 10-0106903 disclosed above exhibit problems in accordance with a constitution and operation of a driving mechanism of the driving motor and the locking pin.

That is, the driving mechanism is constituted by connecting a rotation axis 266 of the driving motor 260 through a square groove 261*a* formed at a rotation stopper 261, by installing a rotation stopper 261 such that the rotation stopper 261 rotates in an insertion groove 234 formed in a second shaft cylinder 230, and by elastically installing a locking pin 240 including a locking axis 242 and a locking projection 241 through a spring 243 having a repulsive force to a through-hole 231 including a jaw portion 231*a* formed in a perpendicular direction to the insertion groove 234 the second shaft cylinder 230, is constituted such that the locking axis 242 disposes toward a release portion 290 and a locking portion 291 formed at an external of diameter the rotation stopper 261, is constituted such that a front end portion of a wire-shaped rotation control spring 265 having a elastic force is fixed to a driving motor 260 and elastically is adhered to a rotation axis 266 of an arc-shape portion formed at both sides having a square column shape, to prevent a rotation axis 266 of the driving motor 260 rotates arbitrarily, and is constituted by forming a rotation prevention jaw 264 at an end portion of the rotation stopper 261 and by installing rotation stop pin 262 at a second shaft cylinder 230 through an installation hole 263 formed at a position perpendicularly corresponding to a rotation prevention jaw 264 such that a predetermined angle rotates when the rotation stopper 261 rotates.

According to the above invention, when the rotation axis 266 of the driving motor 260 reversibly rotates to approximately a 180 degree, the rotation stopper 261 interworking with the rotation axis 266 rotates and thereby positions of the locking portion 291 and the releasing portion 290 formed per a 180 degree direction of the rotation stopper 261 changes, and, accordingly, a locking pin 240 elastically installed in the spring 243 appears and disappears in a locking groove 212. As a result, a first and second shaft cylinder is locked in or released from a body cylinder 210.

In the cylinder-type electronic locking device of Korean Patent No. 10-0106903 constituted and working as described above, the rotation control spring 265 locating in the rotation axis 266 of the driving motor 260 may lease from the rotation axis 266 due to shocks occurring when shocks are added to the driving motor 260 during processes opening and closing doors. Especially, when directions of shocks added to the driving motor 260 are perpendicular to an axis direction, the rotation control spring 265 may be easily detached. Such a phenomenon is because the rotation controls spring 265 plays two functions. That is, first, when both sides of the rotation axis 266 is clamped by the rotation control spring 265, the rotation control spring 265 is elastically estranged during rotation of the rotation axis 266 and thereby rotation load must be minimized such that rotation of the rotation axis 266 is not disturbed. Second, when rotation of the rotation axis 266 stops, in order to prevent arbitrary rotary the rotation axis 266, both sides of the rotation axis 266 must be elastically clamped by the rotation control spring 265 and thereby a wire diameter must be determined such that the rotation control spring 265 performs the both functions which are ambilaterality.

When the wire diameter of the rotation control spring 265 is thick, rotation of the rotation axis 266 is disturbed and thereby load on the driving motor 260 is generated. Accordingly, the diameter of the wire must be thin (namely, the wire must be enable to flap) so as to perform the both functions disclosed above.

In a situation like this, when the rotation control spring 265 is detached from the rotation axis 266 and thereby the rotation axis 266 rotates due to external shocks, the rotation stopper 261 interlocking with the rotation axis 266 arbitrarily rotates and thereby misoperation may occur.

Additionally, since the rotation axis 266 of the driving motor 260 is directly connected to and integrated with the rotation stopper 261, external shocks are directly transferred to the rotation stopper 261 and thereby the rotation stopper 261 arbitrarily rotates, and, accordingly, misoperation occurs.

Next, appearing and disappearing operations of the locking pin 240 are performed by a repulsive force of the spring 243 installed in the through-hole 231. Therefore, when the locking projection 241 of the locking pin 240 is free from the locking groove 212 of the body cylinder 210 and rotates along an inner wall during a releasing operation, friction as much as a repulsive force of the spring 243 occurs and, due to the friction force, the first and second cylinder shafts do not smoothly rotate.

Next, components constituting the driving mechanism includes the rotation axis 266 (first component) of the driving motor 260[2], the rotation control spring 265 (second component) controlling arbitrary rotation of the rotation axis 266, the rotation stopper 261 (third component) connected to the rotation axis 266, the rotation stop pin 262 (fourth component) rotating the rotation stopper 261 up to a predetermined angle, the spring 243 (fifth component) and locking pin 240 (sixth component) locating in a perpendicular direction to the rotation stopper 261 and performing locking and releasing operations. Therefore, due to the complex components, reliability of operation is deteriorated. Furthermore, component costs increase and assemble productivity is deteriorated.

Accordingly, in key cylinders for electronic locking devices, technologies which may increase the reliability of locking and opening operations of a lock pin fluctuating in accordance with operation of a driving motor, which may reduce component costs and may improve assembly productivity by simplifying components used for the operations, and which may protect the components interworking from external shocks by separately assembling driving part of a driving motor and a passive part of the lock pin to improve reliability of operation and durability are still required.

DISCLOSURE

Technical Problem

Therefore, the present invention has been made to provide a key cylinder for an electronic locking device which may improve reliability to locking and opening operation of a lock pin fluctuating in accordance with operation of a driving motor, my reduce component costs by simplifying used components, may improve assemble productivity, and may improve reliability and durability to operation by separately assembling a driving part of the driving motor and a passive part of the lock pin to protect components from external shocks.

Technical Solution

In accordance with one aspect of the present invention, provided is a key cylinder for an electronic locking device including a cylinder housing forming an appearance, and a cylinder plug 11 positioned in an axis direction in the cylinder housing, rotatably installed in place and locking and releasing the cylinder housing, wherein the cylinder plug includes a lock head including a key insertion hole into which a key head of an electronic key is removably inserted to a front side, a printed circuit board exchanging power and authentication data from the publicly known electronic key by installing key connection pins and in a connection housing installed through the lock head, accessing to the key connection pins and equipping with a microprocessor and an electrically erasable programmable read only memory (EEPROM), a driving motor performing normal rotation and reverse rotation drive in accordance with an input signal of the printed circuit board, a spur gear installed in an axis of the driving motor, a lock pin guider fixed in a rear direction of the cylinder plug, a direction conversion rotary ring rotating in accordance with drive of the driving motor by an internal gear rotatably installed through a fixing axis in the center of the lock pin guider and engaged with the spur gear in a front direction and a spiral groove formed in a rear direction, and a lock pin installed in the lock pin guider such that a pin hole formed in a direction perpendicular to an axis direction of the cylinder plug fluctuates, inserted into one side of a spiral groove formed in the direction conversion rotary ring, positioned through a straight guide wall intercommunicating with the pin hole, and appearing and disappearing in lock holes formed in the cylinder housing by moving in a perpendicular direction to axis rotation of the direction conversion rotary ring through installation of a foot pin performing straight line motion to realized locking and release of the key cylinder.

The driving motor may include the spur gear 22 is fixed to the cylinder plug 11 in a front side, next to the lock head 18 through the printed circuit board 24 and the direction conversion rotary ring 27 is rotatably fixed to the lock pin guider 23 fixed to the cylinder plug 11 in a back side with the fixing axis 24 to separately assemble a passive part of the lock pin 15 which receives drive of a driving part and the driving motor 21 of the driving motor 21, in which the spur gear 22 is installed, and then operates by rotation of the direction conversion rotary ring 27 rotary.

The spur gear 22 meshing with the internal gear 25 formed in the direction conversion rotary ring 27 may be spaced from a side portion 38 of the internal gear 25.

The internal gear 25 formed in the direction conversion rotary ring 27 may be meshed with the spur gear 22 connected to the driving motor 21 such that the direction conversion rotary ring 27 rotates having a reduction speed ratio to rotation of the driving motor 21.

The key cylinder for an electronic locking device may further include a rotation control plate 57 positioned at a space between a rotation control jaw 56 formed from side to side at a lower portion of the cylinder housing 50 and inserted through a connection pole for a latch bolt 59 rotatably installed by a snap ring 58 at an inner side of the cylinder housing 50 to limit a rotation angle of the cylinder plug 11.

A prismatic hole 63 coincided with a position fixing plane section 62 formed in the connection pole for a latch bolt 59 may be formed in the center of the rotation control plate 57 and a rotation fixing jaw 64 may be formed on a circumference surface of the prismatic hole 63, to change locking and release directions of the cylinder plug 11 and to control a rotation angle.

The switch 39 may be installed in the printed circuit board 20 and a snap ball housing 40 may be fixed to the printed circuit board 20 to prevent arbitrary rotation of the cylinder plug 11 at a release state of the key cylinder 10, and, through this, a spring 41, a snap switcher 42 and the snap ball 16 may be sequentially installed and the snap ball 16 may be selectively positioned in the first and second snap holes 53 and 54 formed in the cylinder housing 50 through a through-hole 43 of the cylinder plug 11, and the snap ball 16 may be pushed by rotating the cylinder plug 11 through the electronic key 100, and thereby the snap switcher 42 may turn on/off the switch 39, and, accordingly, by drive of the driving motor 21, the lock pin 15 may be selectively positioned in the first and second lock holes 51 and 52 formed in the cylinder housing 50 to maintain a locking state of the cylinder plug 11.

Effects of the Invention

By using a key cylinder for an electronic locking device according to the present invention, opening and releasing operations of a lock pin fluctuating in accordance with operation of a driving motor is performed by rotating a spiral groove through axis direction rotation of a direction conversion rotary ring in accordance with a spur gear rotation of a driving motor and thereby rotates such that a foot pin axis receives direction rotation and change straight line motion. Therefore, a conventional spring may be omitted and simple operation may be realized and, as such, operation reliability may be enhanced and, at the same time, operation reliability from external shocks may be guaranteed.

In addition, the present invention may reduce component costs and improve assemble productivity by realizing simplification of components used from a driving motor to a lock pin.

Furthermore, the present invention may protect components from external shocks by separately assembling a driving part of a driving motor and a passive part of a lock pin and thereby may improve durability and reliability of a product.

BRIEF DESCRIPTION OF THE DRAWINGS

The above and other objects, features and other advantages of the present invention will be more clearly understood from the following detailed description taken in conjunction with the accompanying drawings, in which:

FIG. 1 is a sectional view illustrating a locking state of a cylinder type electronic locking device.

FIG. 2 is a sectional view illustrating a section taken along the line A-A in FIG. 1.

FIG. 3 is a sectional view illustrating a release state of the cylinder type electronic locking device.

FIG. 4 is a sectional view taken along the line B-B in FIG. 3;

DETAILED DESCRIPTION OF THE INVENTION

Hereinafter, embodiments will be described in detail with reference to the accompanying drawings. First of all, it should be understand that terms and words used in the specification and claims are not limited to conventional and dictionary meanings and meanings and concepts coinciding with modifications of the technical spirit of the present invention are covered. Accordingly, embodiments disclosed in the present specification and constituent elements illustrated in drawings are a preferable embodiment and should be understood as part of technical sprit of the present invention. Therefore, when the present invention is applied, various equivalents and modifications, which may substitute the embodiments, are possible.

Figure 1:
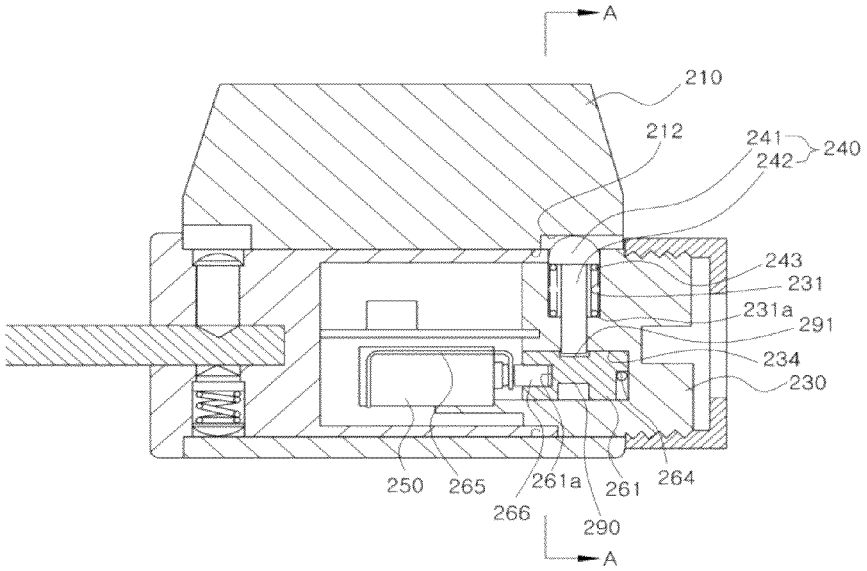
FIGS. 1 to 4 are figures extracted from the publication of Korean Patent No. 10-0106903.
Figure 2:
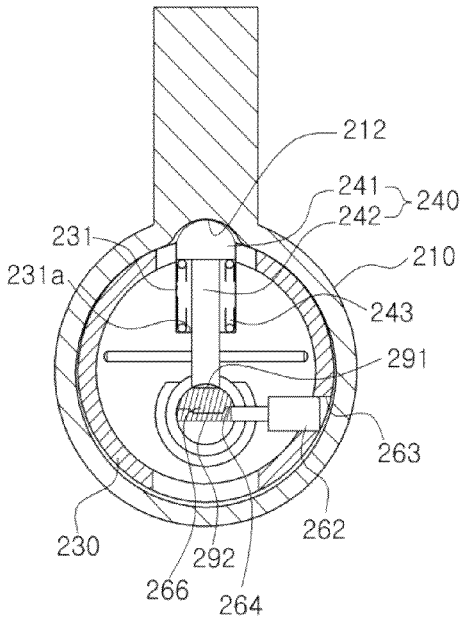
Figure 3:
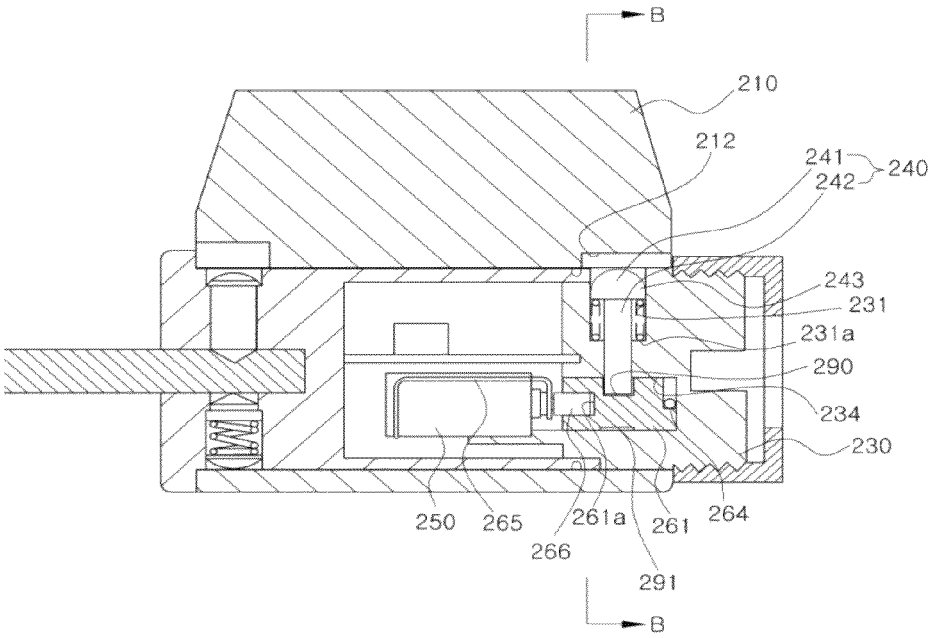
Figure 4:
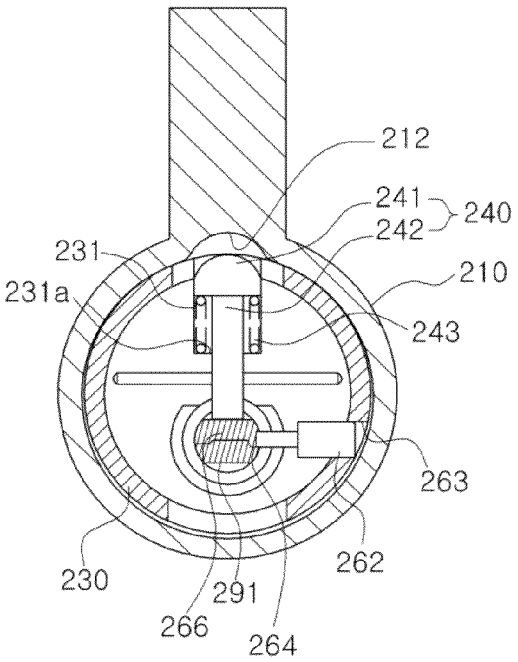
Figure 5:
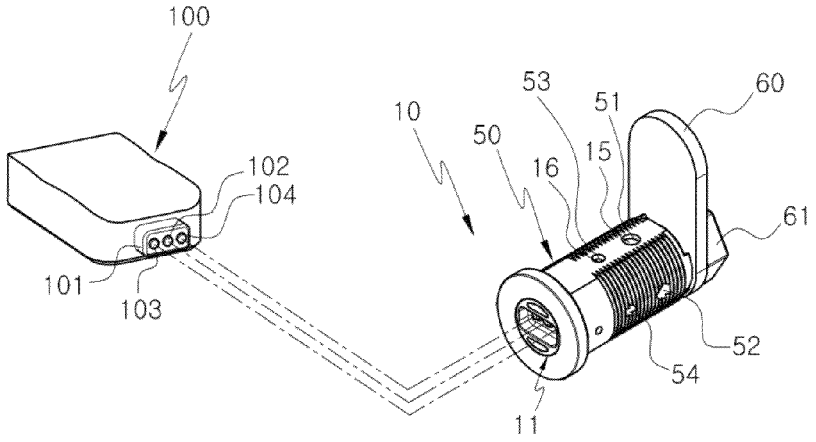
FIG. 5 is oblique views illustrating a whole body of a publicly known electronic key and a whole body of a key cylinder for an electronic locking device according to the present invention.
Figure 6:
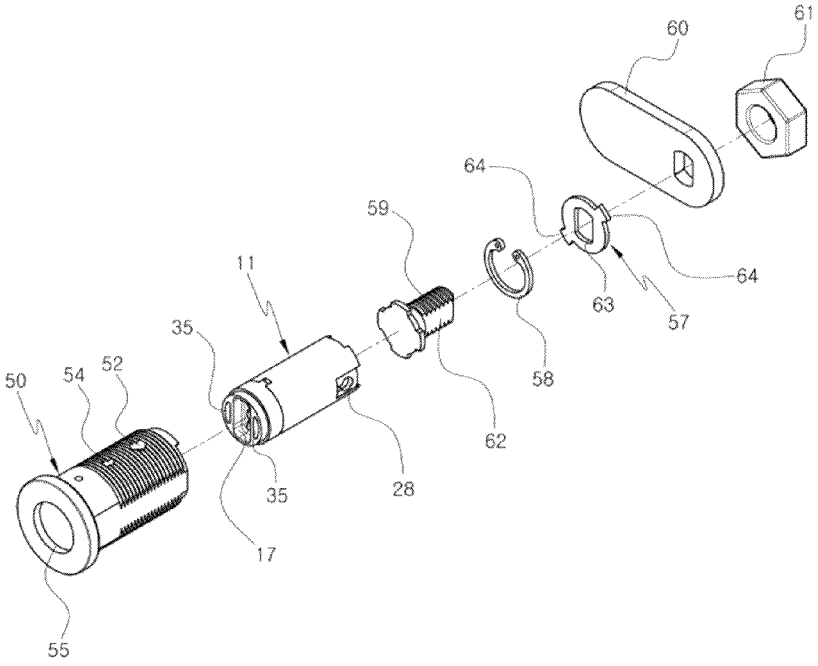
FIG. 6 is a separated oblique view of a key cylinder for an electronic locking device according to the present invention observed in a front direction.
Figure 7:
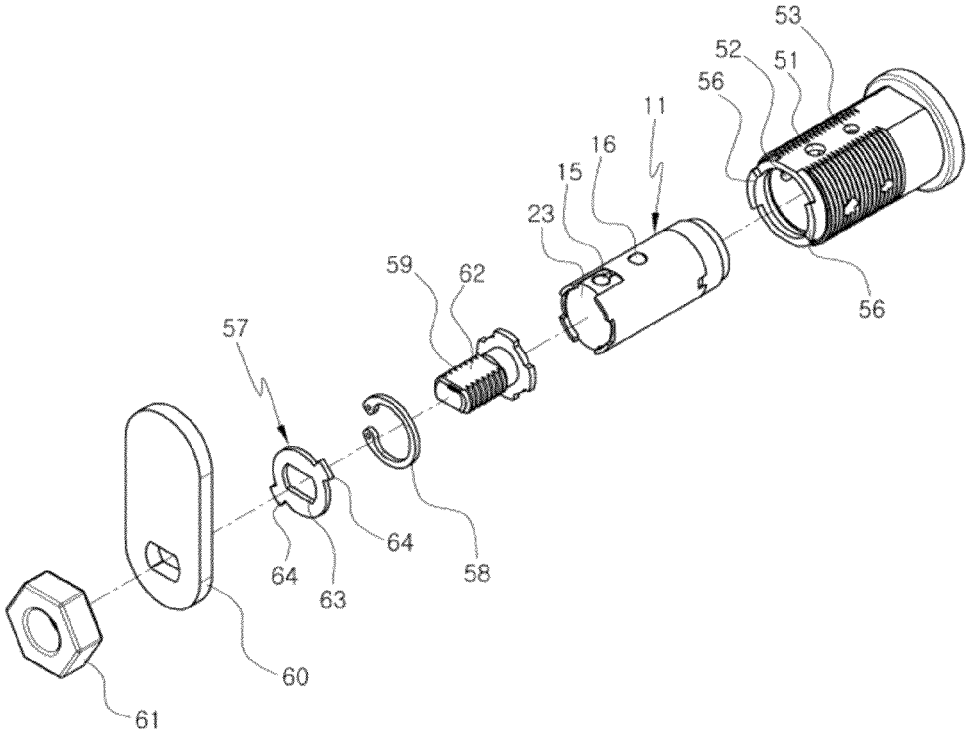
FIG. 7 is a separated oblique view of a key cylinder for an electronic locking device according to the present invention observed in a rear direction.

In a publicly known electronic key 100 illustrated in FIG. 5, a battery supplying power to a key cylinder 10 of the present invention is built in, and a data terminal 102 and cathodic and anodic power supply terminals 103 and 104 are formed at a key head 101 and then are connected to a data terminal 14 (interchangeably used with a key connection pin) and power supply terminals 12 and 13 (interchangeably used with a key connection pin) which are formed at a cylinder plug 11. A printed circuit board (not shown) is installed in the electronic key 100 and thereby the printed circuit board (not shown) is connected to the battery. As a result, a circuit connecting a central processing unit (CPU) (alternatively, a unique chip may be used), an external terminal and the like is constituted. the data terminal 102 connects a communication connection terminal of the CPU to the data terminal 14 of the cylinder plug 11 such that the publicly known electronic key 100 transmits authentication data to the cylinder plug 11 by data-communicating with the cylinder plug 11. A status display LED displaying a battery state may be formed at the electronic key 100.

As illustrated in FIGS. 5 to 9A, a key cylinder for an electronic locking device 10 of the present invention is positioned at a cylinder housing 50 forming an appearance and in the cylinder housing 50 in an axis direction, is installed such that rotation is possible in place, and includes the cylinder plug 11 which is locked and released in the cylinder housing 50.

In the cylinder housing 50, a first lock hole 51 and a second lock hole 52 spaced evenly spaced from the first lock hole 51 are perforated in a direction perpendicular to the axis direction. A first snap hole 53 and second snap hole 54 are perforated near the first and second lock holes 51 and 52 in a form same as the first lock hole 51 and second lock hole 52.

In the above embodiment, the first lock hole 51 and second lock hole 52 are formed are spaced at a 90 degree angle. The first snap hole 53 and second snap hole 54 also are spaced at a 90 degree angle.

At the lock holes 51 and 52, the snap holes 53 and 54, a lock pin 15 and a snap ball 16 are positioned. The lock pin 15 and snap ball 16 will be described below. Considering a design in accordance with rotation directions when the key cylinder 10 is locked and released, the lock holes 51 and 52, and the snap holes 53 and 54 may be previously perforated at a spacing of a 90 degree angle.

As illustrated in FIGS. 5 to 13, to the cylinder plug 11, lock head 18 including a key insertion hole 17 into which the key head 101 of the publicly known electronic key 100 is removably inserted in a front direction, the data terminal 102 formed in the key head 101 of the electronic key 100 through three installation holes 19*a* of a connection housing 19 installed through the lock head 18, and key connection pins 12, 12 and 14 (power supply terminal and date terminal) connected to each of the cathodic and anodic the power supply terminals 103 and 104 are fixed to access to the key connection pins 12, 13 and 14. The cylinder plug 11 is accessed to the key connection pins 12, 13 and 14, and a microprocessor and electrically erasable programmable read only memory (EEPROM) are equipped with the cylinder plug 11. A printed circuit board 20 exchanging power and authentication data from the publicly known electronic key 100 and a driving motor 21 performing normal and reverse rotations in accordance with an input signal of the printed circuit board 20, and a spur gear 22 installed on an axis of the driving motor 21 are installed.

Figure 9A:
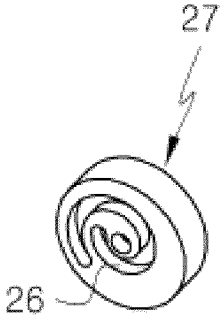
FIGS. 9 (*a*) and (*b*) are an oblique view and a front side view of a direction conversion rotary ring illustrated in FIG. 8 observed in a rear direction, respectively.
Figure 9B:
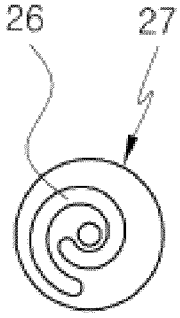
Figure 10:
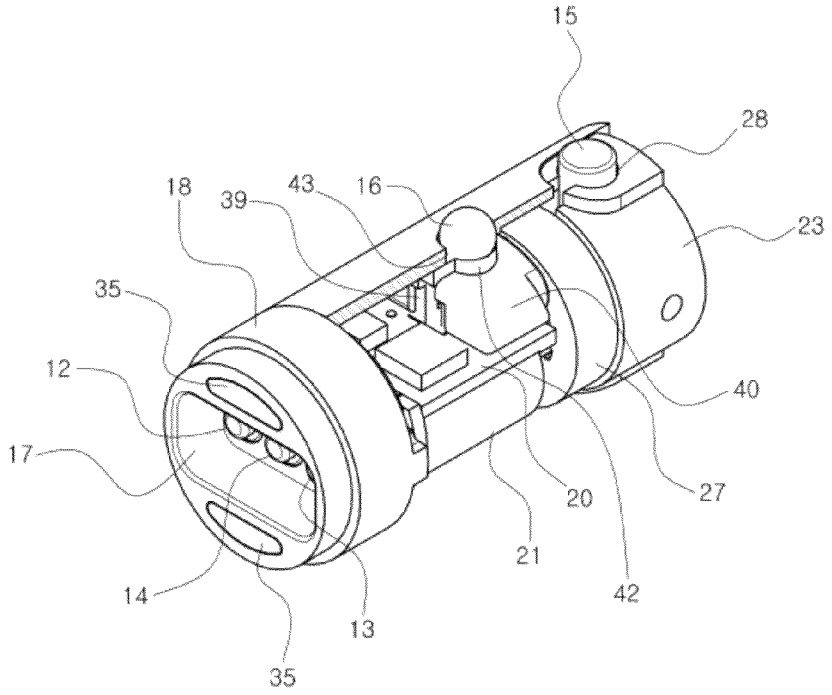
FIG. 10 is an assembly oblique view of a cylinder plug, which is partially sectioned, of a key cylinder for an electronic locking device according to the present invention.
Figure 11:
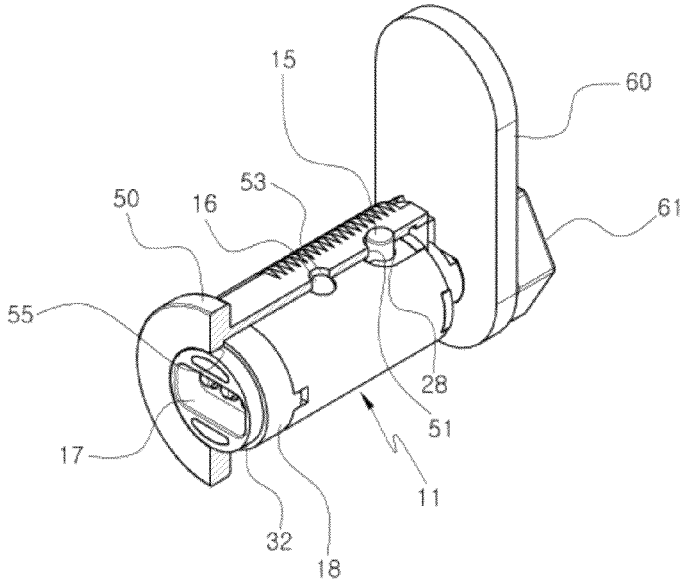
FIG. 11 is an assembly oblique view of a key cylinder, to which a latch bolt is jointed and which is partially sectioned, for an electronic locking device according to the present invention.
Figure 12:
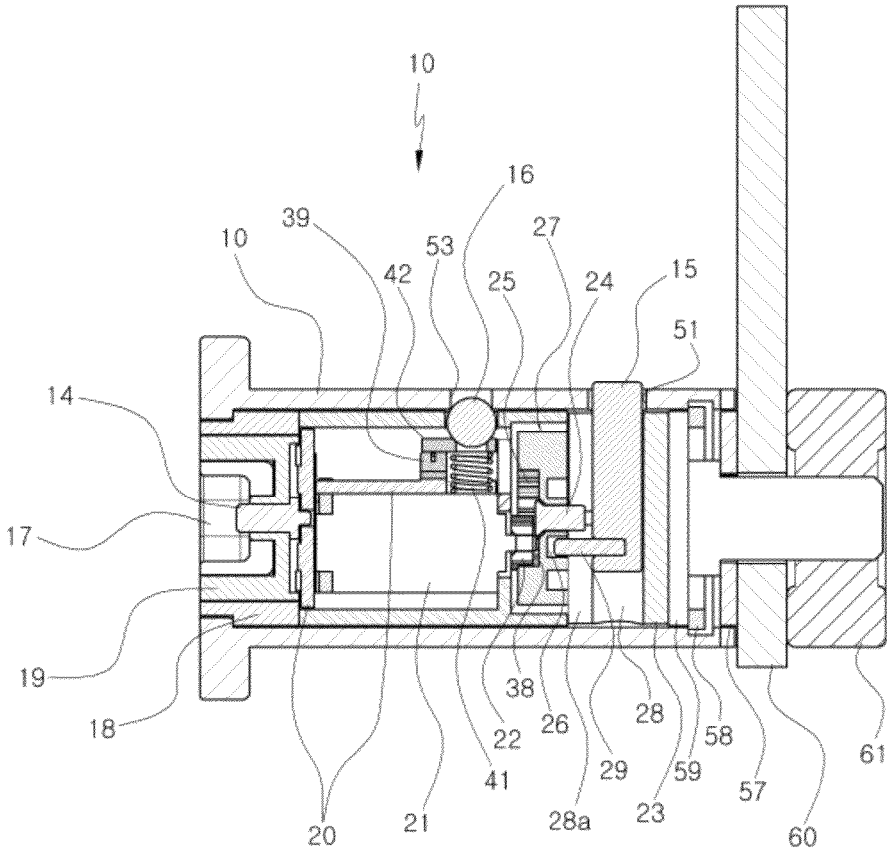
FIG. 12 is an assembly sectional view exemplifying a locking state of a cylinder plug according to the present invention.

A lock pin guider 23 fixed the cylinder plug 11 in a rear direction and an internal gear 25 rotatably installed through a fixing axis 24 in the center of the lock pin guider 23 and engaged with the spur gear 22 in a front direction are formed, and, in a rear direction, a spiral groove 26 is formed, so as to fluctuate in a direction conversion rotary ring 27 rotating in accordance with the driving motor 21. In addition, the lock pin 15 in a pin hole 28 formed in a direction perpendicular to the axis direction of the cylinder plug 11 in the lock pin guider 23, inserted into a spiral groove 26 (See. FIGS. 9 and 12) formed in the direction conversion rotary ring 27 at one side, and appearing and disappearing in lock holes 51 and 52 formed in the cylinder housing 50 by changing a movement direction in a perpendicular direction to a rotation axis of the direction conversion rotary ring 27 through a foot pin 29, which performs straight line motion, positioned through a straight guide wall 28*a* intercommunicating with the pin hole 28 is included to lock and release the key cylinder 10.

A passive part of the lock pin 15 which receives drive of a driving part and the driving motor 21 of the driving motor 21, in which the spur gear 22 is installed, and then operates by rotation of the direction conversion rotary ring 27 rotary is separately assembled in the cylinder plug 11, so as to minimize external shocks of the cylinder plug 11 transferred to the passive part through a driving part such that operation reliability of the lock pin 15 is stabilized.

Accordingly, it is preferable that the driving motor 21 including the spur gear 22 is fixed to the cylinder plug 11 in a front side, next to the lock head 18 through the printed circuit board 20. The direction conversion rotary ring 27 is rotatably fixed to the lock pin guider 23 fixed to the cylinder plug 11 in a back side with the fixing axis 24.

Figure 8:
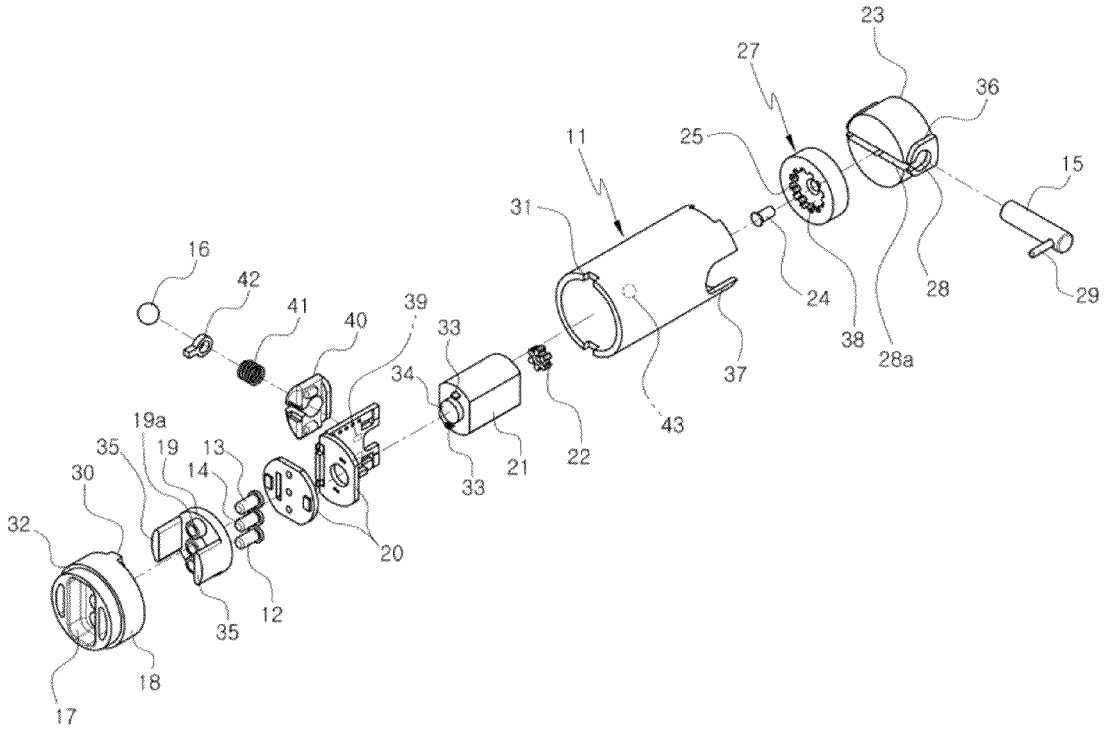
FIG. 8 is an exploded oblique view of a cylinder plug of a key cylinder for an electronic locking device according to the present invention.

In the above, as illustrated in FIG. 8, the lock head 18 engaged through convex portions 30 formed at a rear side and concave portions 31 formed at a front side of the cylinder plug 11. It is preferable that the lock head 18 is fixed to the cylinder plug 11 with a bolt (for example, set screw) (not shown).

A jaw 32 is formed in a front side of the lock head 18 fixed to a front side of the cylinder plug 11 and assembled with the lock head 18 such that the jaw 32 is caught in a jaw 55 formed at a front side of the cylinder housing 50 and falls out.

In the driving motor 21, the printed circuit board 20 is installed through a fixing pin 33 formed at one side and a circular jaw 34. The printed circuit board 20 is connected to and combined with the key connection pins 12, 13 and 14. In addition, an LED display window 35 displaying a connection state may be formed at one side of the connection housing 19.

A position of the lock pin guider 23 may be fixed by shrink fitting a fixing jaw 36 formed at both sides through a fixing groove 37 formed at a lower portion of the cylinder plug 11 and, when desired, may be fixed with a bolt.

As illustrated in FIGS. 8 and 12, the spur gear 22 meshing with the internal gear 25 formed in the direction conversion rotary ring 27 is spaced from a side portion 38 of the internal gear 25 to alleviate shocks transferred to the lock pin 15 through the direction conversion rotary ring 27 by a spacing from the internal gear 25 when the driving motor 21 shakes by external shocks and, by the shaking, the external shocks are transferred to the internal gear 25 through the spur gear 22.

Figure 16:
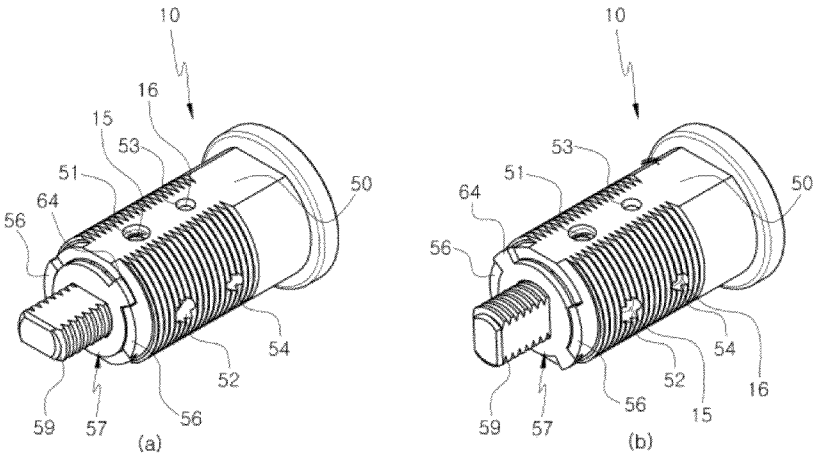
FIGS. 16 and 17 are rear oblique views of key cylinders exemplifying rotation directions of locking and release states changed in accordance with a state of a front side or back side of a rotation control plate according to the present invention positioned at a rotation control jaw.
Figure 17:
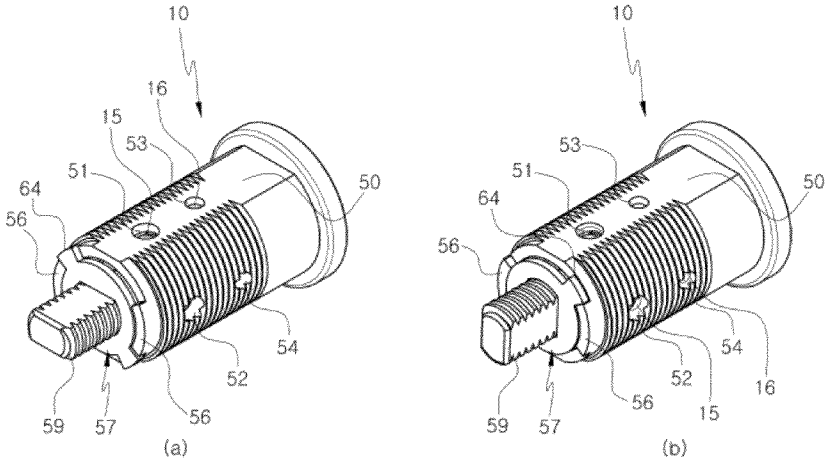

As illustrated in FIGS. 16 and 17, a rotation control jaw 56 is formed from side to side at a lower portion of the cylinder housing 50, a rotation control plate 57 is positioned through a space between the rotation control jaw 56, and the rotation control plate 57 is inserted into a connection pole for a latch bolt 59 rotatably installed by a snap ring 58 at an inner side of the cylinder housing 50 such that the rotation control plate 57 limits a rotation angle of the cylinder plug 11.

Drawing No. 60 indicates a latch bolt 60 inserted into the connection pole for a latch bolt 59. Drawing No. 61 indicates a nut fixing the latch bolt 60 to the connection pole for a latch bolt 59.

In the center of the rotation control plate 57, a prismatic hole 63 coincided with a position fixing plane section 62 formed in the connection pole for a latch bolt 59 is formed. A rotation fixing jaw 64 is formed on a circumference surface of the prismatic hole 63, to change locking and release directions of the cylinder plug 11 and to control a rotation angle.

Meanwhile, to prevent arbitrary rotation of the cylinder plug 11 at a release state of the key cylinder 10, a switch 39 is installed in the printed circuit board 20 and, by driving of the driving motor 21, the lock pin 15 is selectively positioned in the first and second lock holes 51 and 52 formed in the cylinder housing 50 in accordance with turning on/off the switch 39 such that the cylinder plug 11 maintains a locking state.

To realize this, as illustrated in FIGS. 8, 12, 14 and 15, the switch 39 is installed in the printed circuit board 20 and a snap ball housing 40 is installed in the printed circuit board 20. Through this, a spring 41, a snap switcher 42 and the snap ball 16 are sequentially installed and the snap ball 16 is selectively positioned in the first and second snap holes 53 and 54 formed in the cylinder housing 50 through a through-hole 43 of the cylinder plug 11, and the snap ball 16 is pushed by rotating the cylinder plug 11 through the electronic key 100, and thereby the snap switcher 42 turns on/off the switch 39. Accordingly, the driving motor 21 drives and thereby the lock pin 15 is selectively positioned in the first and second lock holes 51 and 52 formed in the cylinder housing 50 such that the cylinder plug 11 maintains a locking state.

In the above, the switch 39 may selectively use a conventional switch controlling on/off such as a pair of photo switches, a pair of micro switches or the like conventionally emitting and receiving infrared light.

The present invention constituted as described above determines operation after comparing with ID, when the key head 101 of the publicly known electronic key 100 is inserted into the key insertion hole 17 of the key cylinder 10, three terminals 102, 103 and 104 of the key head 101 access to the key connection pins 12, 13 and 14 and thereby power is supplied to the cylinder plug 11. Subsequently, the printed circuit board 20 of the cylinder plug 11, in which power is provided, operates and thereby authentication data is transmitted through the data terminal 102 of the electronic key 100. Subsequently, the authentication data is compared with ID stored in EEPROM in a central control unit (CPU) of the printed circuit board 20 and thereby operation is determined.

Figure 13:
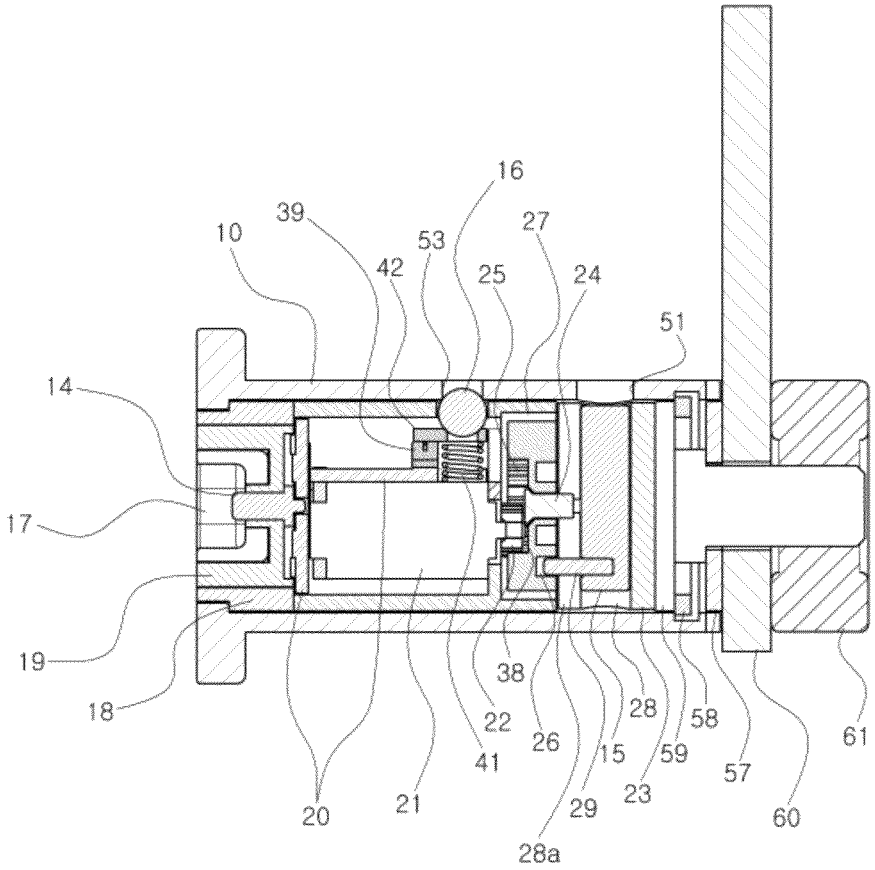
FIG. 13 is an assembly sectional view exemplifying a release state of a cylinder plug according to the present invention.

According to one embodiment of the present invention, first, release (opening) operation of the key cylinder 10 is described. As illustrated in FIGS. 5 and 12, an upper portion of the lock pin 15 is positioned in the first lock hole 51 of the cylinder housing 50 and the snap ball 16 is positioned in the first snap hole 53 such that, when the key cylinder 10 is in a locking state, three terminals 102, 103 and 104 access to the key connection pins 12, 13 and 14 by inserting the key head 101 of the electronic key 100 into the key insertion hole 17 of the key cylinder 10 and a electric signal is transferred to the driving motor 21 through the printed circuit board 20. Accordingly, when the driving motor 21 rotates to an opening direction (for example, normal rotation), the spur gear 22 installed in the driving motor 21 is meshed with internal gear 25 formed in the direction conversion rotary ring 27 to rotate the direction conversion rotary ring 27. Here, a pin foot 29 inserted into the spiral groove 26 is guided in accordance with a rotating spiral groove 26, and, at the same time, is guided to the straight guide wall 28*a* and performs straight line motion. As a result, the lock pin 15 connected to the pin foot 29 performs straight line motion (descend motion) in the pin hole in a direction perpendicular to the axis direction and thereby, as illustrated in FIG. 13, an upper portion of the lock pin 15 is free from first lock hole 51 and the cylinder plug 11 rotates freely in the cylinder housing 50.

In a state as described above, when the electronic key 100 is rightwardly rotated를 rightwardly rotary, the cylinder plug 11 rotates and 90 degree rotation is performed by the rotation control plate 57 rotating with the cylinder plug 11. As a result, the latch bolt 60 is at a release state.

Figure 14:
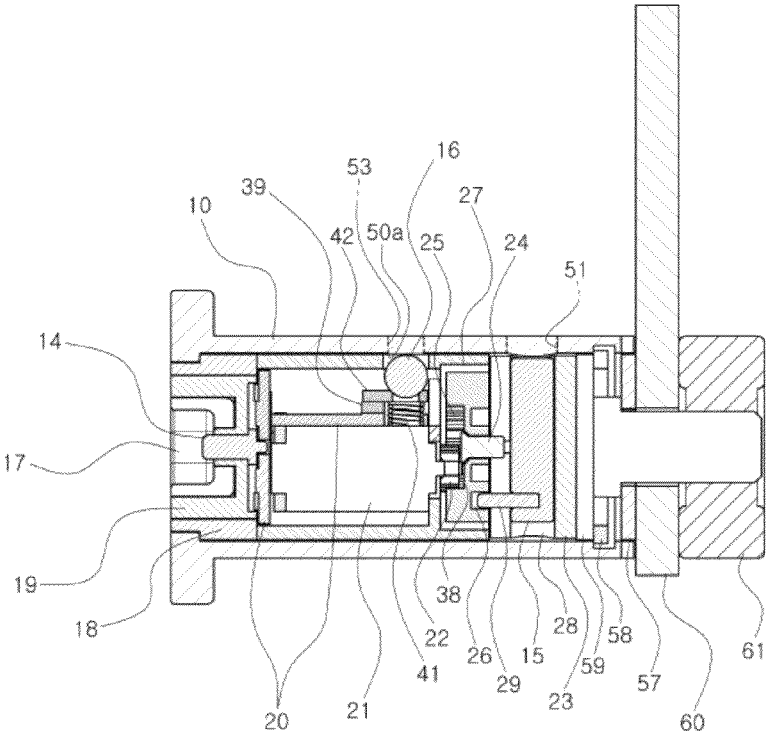
FIG. 14 is an assembly sectional view exemplifying an ON state of a switch by descent of a snap ball according to the present invention and FIG. 15 is a rear oblique view of a key cylinder exemplifying positions of the snap ball and a lock pin after an operation described in FIG. 14.
Figure 15:
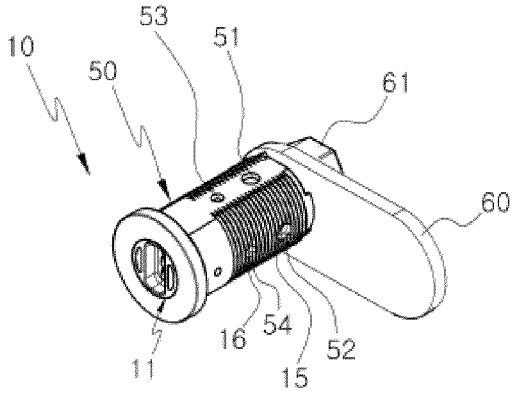

At the same time, the snap ball 16 positioned in the first snap hole 53 of the cylinder housing 50 in FIG. 5 is pushes in an inner wall 50*a* of the cylinder housing 50 by rotation of the cylinder plug 11 as illustrated in FIG. 14. Accordingly, the snap switcher 42 interlocked and pushed with the snap ball 16 turns ON the switch 39 and the cylinder plug 11 continuously rotates, and thereby the snap ball 16 reaches to the second snap hole 54, and, accordingly, by the snap switcher 42 of the spring 41, the snap ball 16 is returned and the switch 39 is changed to an OFF state. As a result, in accordance with reverse rotation drive of the driving motor 21, the direction conversion rotary ring 27 connected to the spur gear 22 rotates and, by lift operation of the lock pin 15 interlocking with the direction conversion rotary ring 27, the lock pin 15 positions at the second lock hole 52 formed in the cylinder housing 50 as illustrated in FIG. 15, and, accordingly, the cylinder plug 11 maintains a locking state.

As described above, the switch 39 is provided such that the driving motor 21 drives in accordance with an ON/OFF state of the switch 39, and thereby the lock pin 15 is positioned at the second lock hole 52 and the cylinder plug 11 is in a locking state. Accordingly, when the key cylinder 10 is in a release state, the cylinder plug 11 gets out of a free rotation state and maintains a locking state to provide reliability.

Next, locking operation of the key cylinder 10 will be described. As illustrated in FIG. 15, the lock pin 15 positions at the second lock hole 52 of the cylinder housing 50 and the snap ball 16 positions at the second snap hole 54, and, accordingly, when the key cylinder 10 is in an opening state, the three terminals 102, 103 and 104 access to the key connection pins 12, 13 and 14 by inserting the key head 101 of the electronic key 100 into the key insertion hole 17 of the key cylinder 10. As a result, an electric signal is transferred to the driving motor 21 through the printed circuit board 20. Accordingly, when the driving motor 21 rotates in a locking direction (for example, normal rotation), the spur gear 22 installed in the driving motor 21 is meshed with the internal gear 25 formed in the direction conversion rotary ring 27 and thereby the direction conversion rotary ring 27 rotates. Here, the pin foot 29 inserted into the spiral groove 26 is guided in accordance with the spiral groove 26 rotating and, as the same time, is guided to the straight guide wall 28*a* and performs straight line motion. Accordingly, the lock pin 15 connected to the pin foot 29 performs straight line motion (descend motion) in the pin hole 28 in a direction perpendicular to the axis direction and thereby the upper portion of the lock pin 15 is free from the second lock hole 52 and the cylinder plug 11 may freely rotate in the cylinder housing 50.

In a stated described above, when the electronic key 100 is leftwardly rotated, the cylinder plug 11 rotates and 90 degree rotation is performed by the rotation control plate 57 rotating with the cylinder plug 11, and, accordingly, the latch bolt 60 stays in a locking state.

At the same time, in FIG. 15, the snap ball 16 positioned at the second snap hole 54 of the cylinder housing 50 is pushed in the inner wall 50*a* of the cylinder housing 50 by rotation of the cylinder plug 11, and thereby the snap switcher 42 interlocking with the snap ball 16 turns ON the switch 39 and the cylinder plug 11 continuously rotates. Accordingly, the snap ball 16 reaches to the first snap hole 53 and thereby the snap switcher 42 and the snap ball 16 return and the switch 39 is changed to an OFF state by a repulsive force of the spring 41. As a result, the direction conversion rotary ring 27 connected to the spur gear 22 rotates in accordance with reverse rotation drive of the driving motor 21 and the snap ball 16 locates at the first lock hole 51 formed in the cylinder housing 50 by lift operation of the lock pin 15 interlocking with the direction conversion rotary ring 27 as illustrated in FIGS. 5 and 12, and, accordingly, the cylinder plug 11 maintains a locking state.

Above, the snap ball 16 functions as turning ON/OFF the switch 39 and fixing a position such that the cylinder plug 11 exactly positions at the first snap hole 53 or the second snap hole 54 formed in the cylinder housing 50 to stop rotation.

Above, the internal gear 25 formed in the direction conversion rotary ring 27 is meshed with the spur gear 22 connected to the driving motor 21 and thereby it is preferable that the direction conversion rotary ring 27 rotates having a reduction speed ratio to rotation of the driving motor 21.

In an embodiment according to this, by performing reduction speed rotation such that the direction conversion rotary ring 27 rotates once when the spur gear 22 rotates two times, rotation torque of the direction conversion rotary ring 27 is increased and, accordingly, straight line motion force of the lock pin 15 interlocking with the direction conversion rotary ring 27 is increased.

FIGS. 16 and 17 are rear oblique views of a key cylinder exemplifying a rotation direction of locking and release states changed in accordance with a state of a front side or a back side of the rotation control plate of the present invention positioned at a rotation control jaw.

FIGS. 16 (*a*) and (*b*) are positioned between the rotation control jaw 56 formed in the cylinder housing 50 through a front side of the rotation control plate 57. (a) indicates a locking state and, when the locking state turns to a left side, (b) indicating an opening state is performed. FIGS. 17 (*a*) and (*b*) are positioned between the rotation control jaw 56 formed in the cylinder housing 50 through a back side of the rotation control plate 57. (a) indicates a locking state and, when the locking state turns to a right side, (b) indicating an opening state is performed.

As described above, by selectively installing between the rotation control jaw 56 through a front side or back side of the rotation control plate 57, locking and opening directions of the key cylinder 10 may be changed.

What is claimed is:

1. A key cylinder for an electronic locking device including a cylinder housing, and a cylinder plug positioned in an axis direction in the cylinder housing, rotatably installed in place and locking and releasing the cylinder housing, wherein the cylinder plug includes a lock head including a key insertion hole into which a key head of an electronic key is removably inserted to a front side, a printed circuit board exchanging power and authentication data from the electronic key by installing a plurality of key connection pins in a connection housing installed through the lock head, accessing to the plurality of key connection pins and equipping with a microprocessor and EEPROM, a driving motor performing normal rotation and reverse rotation drive in accordance with an input signal of the printed circuit board, a spur gear installed in the axis direction of the driving motor, a lock pin guider fixed in a rear direction of the cylinder plug, a direction conversion rotary ring rotating in accordance with drive of the driving motor by an internal gear rotatably installed through a fixing axis in the center of the lock pin guider and engaged with the spur gear in a front direction and a spiral groove formed in a rear direction, and a lock pin installed in the lock pin guider such that a pin hole formed in a direction perpendicular to the axis direction of the cylinder plug fluctuates, inserted into one side of the spiral groove formed in the direction conversion rotary ring, positioned through a straight guide wall intercommunicating with the pin hole, and appearing and disappearing in lock holes formed in the cylinder housing by moving in a perpendicular direction to axis rotation of the direction conversion rotary ring through installation of a foot pin performing straight line motion to realized locking and release of the key cylinder.

2. The key cylinder for an electronic locking device according to claim 1, wherein the driving motor including the spur gear is fixed to the cylinder plug in a front side, next to the lock head through the printed circuit board and the direction conversion rotary ring is rotatably fixed to the lock pin guider fixed to the cylinder plug in a back side with the fixing axis to separately assemble a passive part of the lock pin which receives drive of a driving part of the driving motor, in which the spur gear is installed, and then operates by rotation of the direction conversion rotary ring.

3. The key cylinder for an electronic locking device according to claim 1, wherein the spur gear meshing with the internal gear formed in the direction conversion rotary ring is spaced from a side portion of the internal gear.

4. The key cylinder for an electronic locking device according to claim 1, wherein the internal gear formed in the direction conversion rotary ring is meshed with the spur gear connected to the driving motor such that the direction conversion rotary ring rotates having a reduction speed ratio to rotation of the driving motor.

5. The key cylinder for an electronic locking device according to claim 1, wherein a switch is installed in the printed circuit board and a snap ball housing is fixed to the printed circuit board to prevent arbitrary rotation of the cylinder plug at a release state of the key cylinder, and, through this, a spring, a snap switcher and the snap ball are sequentially installed and the snap ball is selectively positioned in a first and second snap holes formed in the cylinder housing through a through-hole of the cylinder plug, and the snap ball is pushed by rotating the cylinder plug through the electronic key, and thereby the snap switcher turns on/off the switch, and, accordingly, by drive of the driving motor, the lock pin is selectively positioned in the lock holes formed in the cylinder housing to maintain a locking state of the cylinder plug.

6. The key cylinder for an electronic locking device according to claim 1, further comprising a rotation control plate positioned at a space between a rotation control jaw formed from side to side at a lower portion of the cylinder housing and inserted into a connection pole for a latch bolt rotatably installed by a snap ring at an inner side of the cylinder housing to limit a rotation angle of the cylinder plug.

7. The key cylinder for an electronic locking device according to claim 6, wherein a prismatic hole coincided with a position fixing plane section formed in the connection pole for a latch bolt is formed in the center of the rotation control plate and a rotation fixing jaw is formed on a circumference surface of the prismatic hole, to change locking and release directions of the cylinder plug and to control a rotation angle.

* * * * *